United States Patent [19]

Sarcia

[11] Patent Number: 4,481,777

[45] Date of Patent: Nov. 13, 1984

[54] CRYOGENIC REFRIGERATOR

[75] Inventor: Domenico S. Sarcia, Carlisle, Mass.

[73] Assignee: CVI Incorporated, Columbus, Ohio

[21] Appl. No.: 505,152

[22] Filed: Jun. 17, 1983

[51] Int. Cl.[3] ..... F25B 9/00

[52] U.S. Cl. ..... 62/6; 60/520

[58] Field of Search ..... 62/6; 60/517, 518, 519, 60/520

[56] References Cited

U.S. PATENT DOCUMENTS

| | | | |
|---|---|---|---|
| 3,991,585 | 11/1976 | Mulder | 62/6 |
| 3,991,586 | 11/1976 | Acord | 62/6 |
| 4,044,558 | 8/1977 | Benson | 62/6 |
| 4,388,809 | 6/1983 | Sarcia | 62/6 |
| 4,389,850 | 6/1983 | Sarcia | 62/6 |
| 4,391,103 | 7/1983 | Sarcia | 62/6 |

*Primary Examiner*—Ronald C. Capossela
*Attorney, Agent, or Firm*—Seidel, Gonda & Goldhammer

[57] ABSTRACT

In a cryogenic refrigerator, a refrigerant is circulated in a fluid flow path between first and second chambers by the movement of a displacer means. A slide is connected to the displacer means and reciprocated by a motor. The slide has an axial passage communicating the first and second chambers. The slide has a piston for varying the volume of gas in a third chamber during its reciprocation. The need for a separate compressor is eliminated.

8 Claims, 6 Drawing Figures

CRYOGENIC REFRIGERATOR

BACKGROUND OF THE INVENTION

The present invention is an improvement on the Gifford-McMahon cycle. Familiarity with said cycle is assumed. In such cycle there is provided a discrete compressor which adds substantial weight, bulk and cost. The compressor is needed to convert the low pressure gas to high pressure gas.

The present invention is directed to a solution of the problem of how to minimize the number of moving parts, decrease bulk, decrease size, etc. in a cryrogenic refrigerator.

SUMMARY OF THE INVENTION

The present invention is directed to a cryrogenic refrigerator in which a movable displacer means cooperates with first and second chambers of variable volume. A refrigerant fluid is circulated in a fluid flow-path containing a regenerator between said first chamber and said second chamber by movement of the displacer means. A slide is connected to the displacer means. A motor means is associated with the slide for reciprocating the slide and displacer means as a unit between top dead center and bottom dead center.

The slide has an axial passage communicating the first chamber with the second chamber. One of the slide and displacer means, such as the slide, has a piston for varying the volume of gas in the third chamber during reciprocation. A valve is provided for controlling flow of high and low pressure fluid between the third chamber and the first chamber when said displacer means is at one extremity of its movement and between said third chamber and said second chamber when the displacer means is at the other of the extremities of its movement. The valve includes a movable valve member which is one of said slide and displacer means.

It is an object of the present invention to provide a novel cryogenic refrigerator which does not require a discrete source of high pressure such as a compressor.

It is another object of the present invention to minimize the number of moving parts in a cryogenic refrigerator while at the same time increasing the area within a P-V diagram resulting in an increase in available refrigeration.

Other objects and advantages will appear hereinafter.

For the purpose of illustrating the invention, there is shown in the drawings a form which is presently preferred; it being understood, however, that this invention is not limited to the precise arrangements and instrumentalities shown.

DETAILED DESCRIPTION OF FIRST EMBODIMENT

Figures 1, 4:
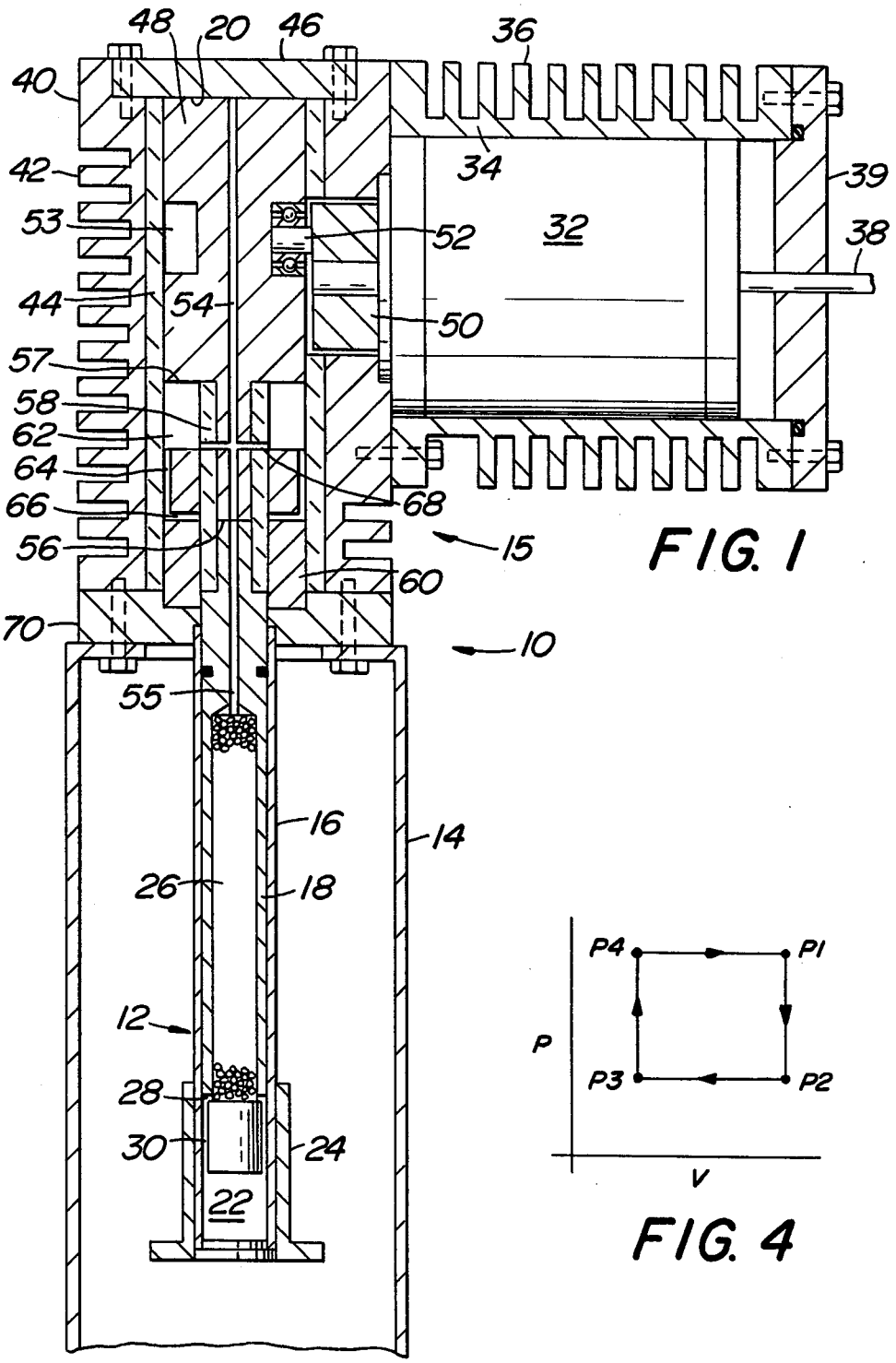
FIG. 1 is a vertical sectional view of a refrigerator in accordance with a first embodiment of the present invention with the displacer at top dead center position.
FIG. 4 is a P-V diagram of the second chamber.

Referring to the drawing in detail, wherein like numerals indicate like elements, there is shown in FIG. 1 a cryogenic refrigerator in accordance with the present invention and designated generally as 10. The refrigerator 10 has only a first stage 12. When in use, stage 12 is disposed within a vacuum housing 14 attached to the head 15. It is within the scope of the present invention to have one or more stages. Each stage includes a housing 16 within which is provided a displacer 18. A warm chamber 20 is provided at the upper end of head 15. A cold chamber 22 is provided at the lower end of stage 12 within housing 16. The designations warm and cold are relative as is well known to those skilled in the art.

A heat station 24 in the form of a tube having a flanged ring and made from a good heat conductive material is attached to the lower end of housing 16 and surrounds the cold chamber 22. Heat station 24 may have other configurations as is well known to those skilled in the art.

Within the displacer 18, there is provided a regenerator 26 containing a matrix. Radially disposed passages 30 communicate the lower end of the regenerator 26 with a clearance space 32 disposed between the outer periphery of the lower end of the displacer 18 and the inner periphery of the housing 16. Thus, the lower end of the regenerator 26 communicates with the cold chamber 22 by way of passages 30 and clearance space 32 which is an annular heat gap exchanger.

The matrix of the regenerator 26 is preferably a stack of 250 mesh material having high specific heat such as oxygen free copper. The matrix has a low void area and low pressure drop. The matrix may be other materials such as lead spheres, nylon, glass, etc.

An electrical motor 32 is disposed within a motor housing 34. Housing 34 has radially outwardly directed fins 36 on its outer peripheral surface. An electrical conduit 38 is coupled to the motor 32 by way of an opening in a removable end wall 39 on the housing 34. Housing 34 is removably coupled in any convenient manner to a housing 40 having radially outwardly directed fins 42 on its outer peripheral surface. Housing 40 has a bore within which is provided a ceramic clearance seal bearing 44. The upper end of the bore in housing 40 is removably closed by a cover 46.

Within the bearing 44 there is guided a slide 48. Slide 48 is reciprocated by the motor 32. The output shaft on motor 32 includes a crank 50 having an eccentric pin 52. Pin 52 is surrounded by ball bearings and is disposed within a peripheral groove 53 on the outer periphery of slide 46. As crank 50 rotates in one direction, slide 48 is reciprocated between top dead center and top bottom dead center. In FIG. 1, the slide 48 and displacer 18 are illustrated at top dead center.

Slide 48 is provided with an axial passage 54. Displacer 18 has an axial passage 55. The passages 54 and 55 coincide with one another. Slide 48 has a reduced diameter portion metallurgically bonded by brazing or welding to a comparable reduced diameter portion on the upper end of displacer 18. The last mentioned reduced diameter portions are surrounded by a ceramic clearance seal bearing 58. Since slide 48 is connected to displacer 18, they move as a unit with their bearing 58.

Within the lower end of the bore in bearing 44, there is provided a combination bearing and valve member 60. Member 60 has an axial bore in contact with the outer periphery of bearing 58. The upper end of member 60 is spaced from the juxtaposed piston face 57 of slide 48 in FIG. 1 so as to define a chamber 62. Chamber 20 may be be considered a first chamber with chamber 22 being the second chamber and chamber 62 being the third chamber.

The upper end portion of member 60 has axially directed passages 64 on its outer periphery. The lower end of passages 64 communicate with radially disposed passages 66. The length of passages 64 corresponds to the stroke of displacer 18. A passage 68 extends radially across the bearing 58 and the reduced diameter portion of slide 48. As illustrated in FIG. 1, passage 68 communicates chamber 62 with chamber 22 by way of passages 54 and 55 and the regenerator 26. Passage 68 could be located in the reduced diameter portion of displacer 18 if the length thereof was increased and the length of the slide 48 correspondingly decreased. Thus, it makes no difference whether the passage 68 is in the slide 48 or in the displacer 18.

The housing 40 is provided with a bottom plate 70 removably attached thereto. The plate 70 has a recess in its upper surface into which the member 60 extends. That relationship assures that the plate 70 and member 68 will always be coaxial.

The refrigerator 10 may be associated with a cryopump which includes chevron vanes which are optically dense and cause gases such as oxygen and nitrogen to adhere thereto. Noble gases can be absorbed by charcoal in pan associated with the heat station 24 as a second stage.

Operation of the first embodiment is as follows.

In FIG. 1, the volume of chamber 20 is at a minimum while the sub-low pressure volume of chamber 62 is at a maximum and the cold high pressure volume at chamber 22 is at a maximum. Passage 68 is fully open thereby allowing the high pressure gas within the regenerator 26 and chamber 22 to exhaust up through passages 55, 54 to chamber 62. After the high pressure cold gas has expanded up through the regenerator, the pressure in chamber 62 is at the same value as in chamber 22. The pressure in chamber 22 drops from P1 to P2 during said pressure change as shown in FIG. 4.

Figure 2:
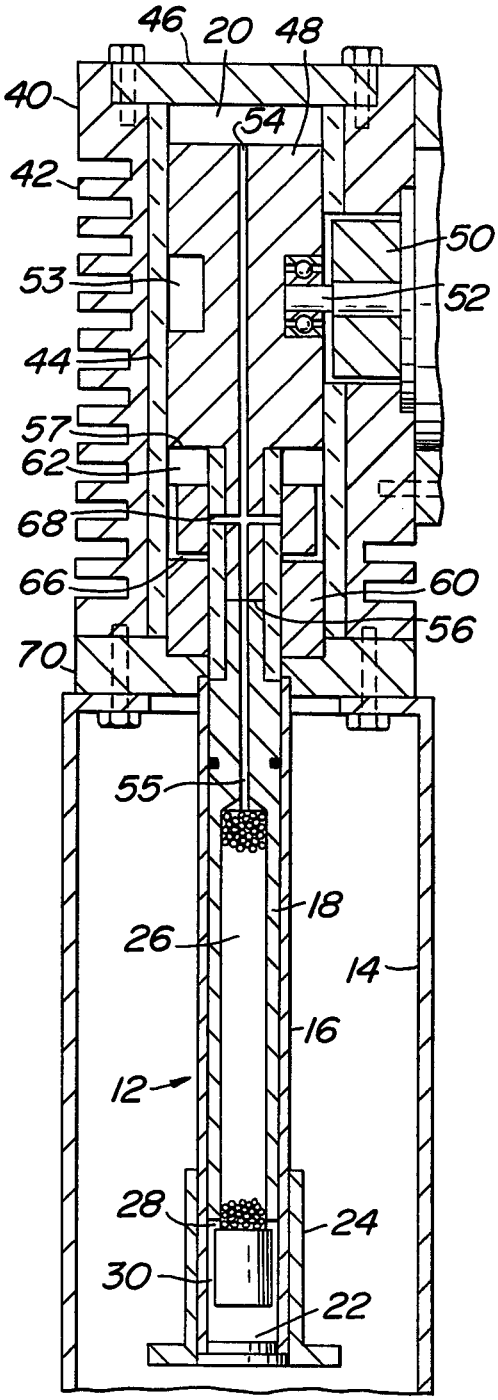
FIG. 2 is a view similar to FIG. 1 but showing the displacer at an intermediate position.

As the displacer 18 starts to move downwardly, due to the interrelationship of motor 32 and slide 48, the size of chamber 20 increases. Compare FIGS. 1 and 2. As shown in FIG. 2, passage 68 is closed and the volume of chamber 62 decreases. The low pressure gas in chamber 22 is being displaced up through the regenerator 26 and into chamber 20 and its volume expands. As the displacement volume increases, the pressure in chamber 22 is being lowered even further. The low pressure gas in chamber 62 is being compressed by piston surface 57. As the displacer 18 continues to move downwardly, the pressure of the gas within chambers 20 and 22 is lowering and the gas in chamber 62 is being further compressed. The pressure in chamber 22 is now at P3 in FIG. 4. Just before the slide 48 and displacer 18 reach bottom dead center, the gas within chamber 62 is fully compressed. The sub-low cold pressure in chamber 22 is now at a minimum and the pressure in chamber 20 is at a maximum.

Figure 3:
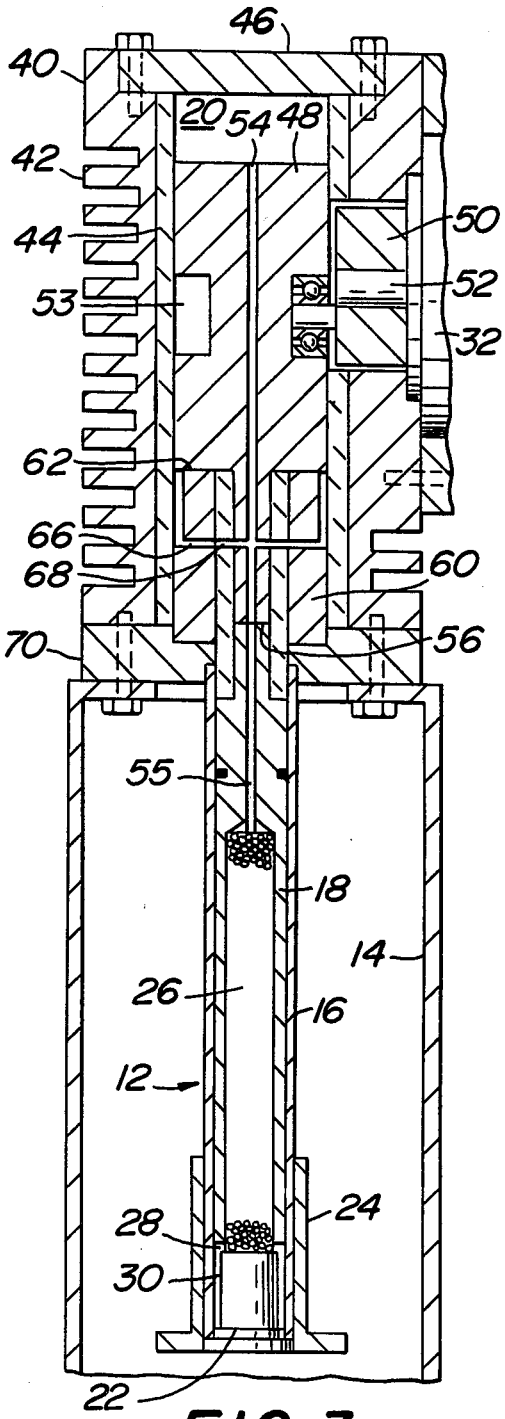
FIG. 3 is a view similar to FIG. 1 but showing the displacer at bottom dead center position.

When the slide 48 and displacer 18 reach bottom dead center, as shown in FIG. 3, the passage 68 communicates with passage 66. High pressure gas from chamber 62 now expands into chambers 20 and 22 and the regenerator 26. The pressure in chamber 22 has now increased from P3 to P4 in FIG. 4.

As the displacer 18 moves upwardly from bottom dead center, the gas in chamber 20 is being displaced downwardly through passages 54, 55 and regenerator 26 to the chamber 22. The pressure within chamber 62 is lowering due to its expanding volume. Chamber 62 is isolated from passages 54, 55.

As the displacer 18 and slide 48 approach top dead center, all of the high pressure gas in chamber 20 occupies the void column of the regenerator 26 and cold chamber 22. The pressure in chamber 22 is now at P1 in FIG. 4. Pressure within chamber 62 is now at a minimum pressure. Passage 68 is about to communicate with chamber 62 and thereby start to exhaust the cold high pressure gas in chamber 22. The cycle is now complete.

The refrigerator of the present invention has a minimum number of moving parts. The slide 48 and displacer 18 move together as a unit and would constitute one working part. Motor 32 and crank 50 constitute two additional moving parts for a total of only three moving parts. As a result of the ceramic clearance seal bearings 44 and 58, no static seals are required. Apparatus 10 is a sealed unit since no connection for communication with an external pressure source is used.

The transfer of working fluid between the volume of compression and volume of expansion in chamber 62 allows the working fluid to be displaced at a constant pressure. The effect on the cold working volume is an increase of area within the P-V diagram resulting in an increase in available refrigeration as compared with a Sterling Cycle which is the only other cycle known to me which does not require a discrete compressor. While the Sterling Cycle does not have a discrete compressor, the pressure wave therein is 90° out of phase with the displacer which results in a reduced P-V diagram.

A typical embodiment operates at the rate of about 200 cycles per minute. The length of the stroke of the movable members, namely displacer 18 and slide 48 is short such as 30 mm. Since one of the displacer 18 and slide 48 acts as a valve member, a separate discrete valve is not required. Thus, it will be noted that the slide 48 provides a multiplicity of functions including coupling displacer 18 to the motor 32, providing communication via passage 54 between warm chamber 20 and the displacer 18, valves flow between chamber 62 and the chamber 20, 22, etc.

To maximize pressure during cool down and steady state operation, an additional source of gas is needed. When a cool down is started, all internal volumes including motor housing 34 are at some start up pressure. As cooling is achieved, the overall pressure drops. Gas within the motor housing 34 or some other source is permitted to leak into the working volumes to increase the overall working pressure. Such leakage from motor housing 34 on cool down and to motor housing 34 on heat up may be attained in several ways. For example, clearance may be provided between the upper ends of slide 48 and bearing 44, or by way of a small orifice in housing 40 between chamber 20 and motor housing 34, or by a pair of oppositely disposed spring load check valves in flow passages extending between chamber 20 and motor housing 34.

DESCRIPTION OF SECOND EMBODIMENT

Figure 5:
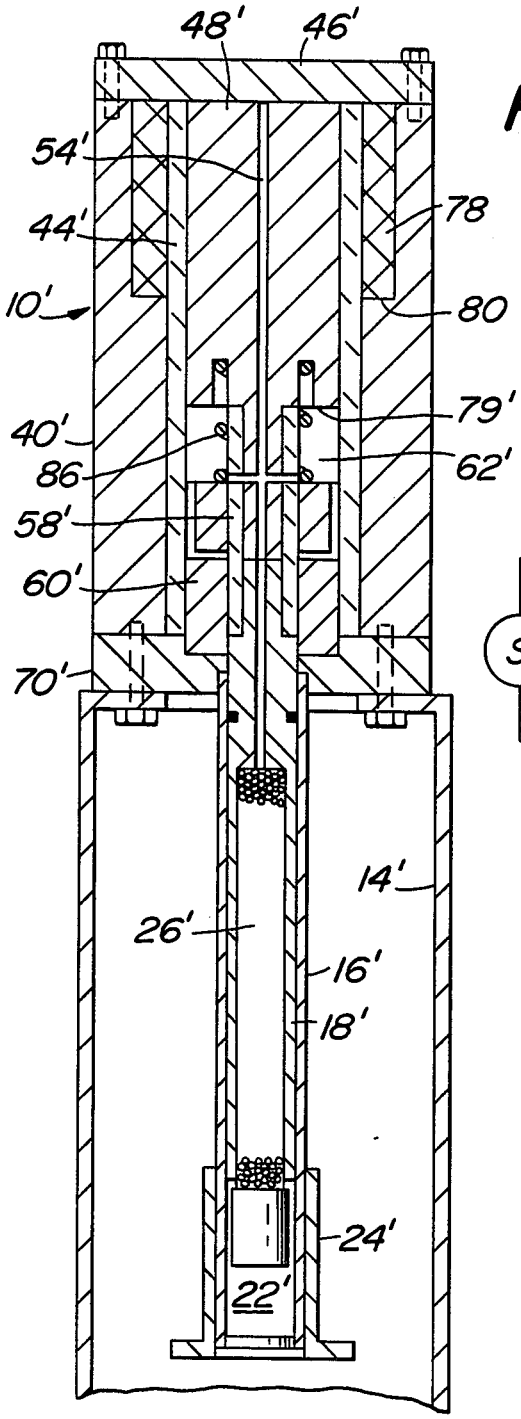
FIG. 5 is a view similar to FIG. 1 but showing another embodiment of the present invention.
Figure 6:
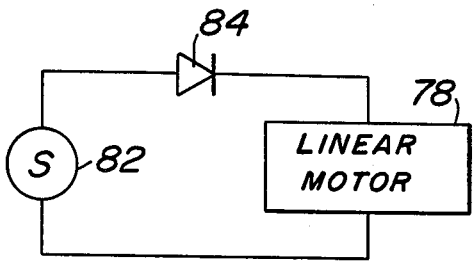
FIG. 6 is a diagrammatic circuit diagram.

In FIGS. 5 and 6 there is illustrated another embodiment of the present invention wherein the cryogenic refrigerator is designated generally as 10'. The refrigerator 10' is the same as refrigerator 10 except as we made clear hereinafter. Corresponding elements in the refrigerators are designated by corresponding primed numerals.

In place of the motor 32, the refrigerator 10' includes a linear motor coil 78 recessed within the housing 40' on the shoulder 80. The motor 78 is coupled to a source of alternating potential 82 by way of a diode 84 as shown in FIG. 6. Motor 78 causes the displacer 18' and the slide 48' to move from top dead center position to bottom dead center position and compresses spring 86. The displacer 18' and slide 48' move from bottom dead center position to top dead center position under the expansive force of the spring 86. There is only one moving part in the refrigerator 10', namely the displacer 18' and slide 48' which move as a unit. The refrigerator 10' is otherwise identical with refrigerator 10.

The present invention may be embodied in other specific forms without departing from the spirit or essential attributes thereof and, accordingly, reference should be made to the appended claims, rather than to the foregoing specification, as indicating the scope of the invention.

I claim:

1. In a cryogenic refrigerator comprising a movable displacer means within an enclosure and cooperating with first and second chambers of variable volume, and in which a refrigerant fluid is circulated in a fluid flowpath containing a regenerator between said first chamber and said second chamber by the movement of said displacer means, means for guiding a slide connected to the displacer means, motor means associated with said slide for reciprocating said slide and said displacer means as a unit between top dead center and bottom dead center, said slide having an axial passage communicating said first chamber with said second chamber, one of said slide and displacer means having a piston for varying the volume of gas in a third chamber during said reciprocation, a valve for controlling flow of high and low pressure fluid between said third chamber and said first chamber when said displacer means is at one extremity of its movement and between said third chamber and said second chamber when the displacer means is at the other of the extremities of its movement, said valve including a movable valve member which is connected to one of said slide and displacer means.

2. A cryogenic refrigerator in accordance with claim 1 including a housing having a ceramic clearance seal bearing within which is disposed said first chamber, slide, third chamber and valve.

3. In a refrigerator in accordance with claim 2 wherein said motor is a linear electrical motor disposed within said housing, said slide and displacer means being the only movable elements.

4. In a refrigerator in accordance with claim 1 wherein said piston and movable valve member are a portion of said slide.

5. In a cryogenic refrigerator comprising a movable displacer means within an enclosure and cooperating with first and second chambers of variable volume, and in which a refrigerant fluid is circulated in a fluid flowpath containing a regenerator between said first chamber and said second chamber by the movement of said displacer means, housing means for guiding a slide connected to the displacer means, said slide being a movable surface at said first chamber, said flow path including axial passages in said slide and displacer means, motor means associated with said slide for reciprocating said slide and said displacer means as a unit between top dead center and bottom dead center, one of said slide and displacer means having a piston for varying the volume of gas in a third chamber during said reciprocation, said third chamber being located in said housing means and being coaxial with said slide, and a valve for controlling flow of high and low pressure fluid between said third chamber and said flow path when said displacer means is at the extremities of its movement.

6. In a refrigerator in accordance with claim 5 wherein said piston is an integral annular portion of said slide.

7. In a refrigerator in accordance with claim 6 wherein said valve includes a movable valve member which is connected to one of said slide and displacer means.

8. In a refrigerator in accordance with claim 7 including an annular bearing member which surrounds a portion of said slide and defines one extremity of said third chamber, said bearing member being a stationary portion of said valve, a clearance seal bearing on said portion of said slide, said slide having a radial flow passage extending from the periphery of said clearance seal bearing to the axial flow passage in said slide.

* * * * *